US006446760B1

(12) United States Patent
Lisi

(10) Patent No.: US 6,446,760 B1
(45) Date of Patent: Sep. 10, 2002

(54) SAFETY CIRCUIT FOR AN ELEVATOR INSTALLATION

(75) Inventor: Antonio Lisi, Losone (CH)

(73) Assignee: Inventio AG, Hergiswil NW (CH)

( * ) Notice: Subject to any disclaimer, the term of this patent is extended or adjusted under 35 U.S.C. 154(b) by 184 days.

(21) Appl. No.: 09/669,174

(22) Filed: Sep. 25, 2000

(30) Foreign Application Priority Data

Oct. 8, 1999 (EP) ..... 99810919

(51) Int. Cl.[7] ..... B66B 1/34
(52) U.S. Cl. ..... 187/391
(58) Field of Search ..... 187/280, 316, 187/391, 393, 247, 296, 297; 49/26, 120; 361/54, 56, 57, 79, 86, 87

(56) References Cited

U.S. PATENT DOCUMENTS 5,083,653 A * 1/1992 Sakata et al. ..... 198/322
5,321,216 A * 6/1994 Jamieson et al. ..... 187/280
5,392,879 A * 2/1995 Boyce et al. ..... 187/316
5,407,028 A * 4/1995 Jamieson et al. ..... 187/287
5,487,448 A * 1/1996 Schollkopf et al. ..... 187/247
5,549,179 A * 8/1996 Herkel et al. ..... 187/287
5,886,497 A * 3/1999 Zaharia ..... 318/779
6,186,281 B1 * 2/2001 Pietrzykowski et al. .... 187/287
6,193,019 B1 * 2/2001 Sirigu et al. ..... 187/391
6,269,910 B1 * 8/2001 Fargo et al. ..... 187/287

FOREIGN PATENT DOCUMENTS

FR 2 777 087 4/1998
JP 07002472 A * 1/1995 ..... B66B/13/14

* cited by examiner

*Primary Examiner*—Jonathan Salata
(74) *Attorney, Agent, or Firm*—MacMillan, Sobanski & Todd, LLC

(57) ABSTRACT

An elevator safety circuit has a series chain of contacts connected between at least one safety relay and an electric power supply and a monitoring device monitoring the voltage and current in the series chain. A signal from the safety relay is transmitted to an elevator control. The voltage across the safety relay is tapped and transmitted to a network connected to a voltage converter of the power supply. If all the contacts of the series chain are closed, the voltage across the safety relay is held constant. Regulation of the voltage across the safety relay makes the safety circuit, with respect to voltage drop, independent of the length of the cabling connecting the contacts.

13 Claims, 2 Drawing Sheets

SAFETY CIRCUIT FOR AN ELEVATOR INSTALLATION

BACKGROUND OF THE INVENTION

The invention relates to a safety circuit for an elevator installation consisting of a chain of switches connected in series to monitor the equipment serving the safety of the elevator operation, and of a source of electric voltage to supply the series chain, there being connected to the end of the series chain at least one switching device which generates signals for an elevator control depending on the switching status of the switches.

A safety circuit for an elevator installation consists of a chain of door contacts connected in series, a contact being provided for the purpose of, for example, monitoring the position of a hoistway door. Further contacts or switches for the purpose of monitoring, for example, the position of the car door, the position of the brake, or other equipment serving the safety of the elevator operation, can be connected into the safety circuit. The safety circuit is usually supplied with impulses of direct voltage from either an AC or DC source of voltage, there being connected to the end of the safety circuit at least one safety relay. If all contacts are closed, the safety relay is activated. The elevator control monitors the status of the safety relay and if the safety relay is activated, the elevator control releases, for example, a pending travel command.

A disadvantage of this type of electrical supply to the safety circuit is that the output voltage of the voltage source is not regulated and is subject to voltage fluctuations which in turn makes relays with a wide voltage range necessary. Furthermore, the voltage has a value greater than a safe low voltage, and to prevent electrical accidents must be protected with a fault-current safety switch.

SUMMARY OF THE INVENTION

It is here that the invention sets out to provide a remedy. The present invention provides a solution to avoiding the disadvantages of the known device and creating a safety circuit that operates safely irrespective of the travel height of the elevator.

The advantages derived from the invention are essentially that the voltage across the safety relay is held constant. The voltage across the safety relay therefore no longer depends on the length of the cabling of the safety contacts, which is of particular significance on elevator installations with very high travel. The cabling of the door contacts extends over the full height of the elevator hoistway and, if there is no regulation, has a direct influence on the voltage across the safety relay. If the voltage is regulated, power supply voltage fluctuations, or changing contact resistances on the contacts, or other loads in the safety circuit which influence the voltage, have no effect on the safety relay. If the voltage across the safety relay is regulated, a commercially available standard relay can be used as the safety relay without detriment to the reliable operation of the safety circuit. Moreover, the safety circuit can be operated with physiologically safe low voltage. In particular, measures for the protection of persons are not necessary. With regulated voltage across the safety relay, a safety circuit can be made with high operational safety and low costs.

When the safety circuit is open, a limiter acting through a network of the regulating circuit limits the supply voltage to a specific value. Moreover, the safety circuit operates with a low voltage which is not dangerous to persons.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
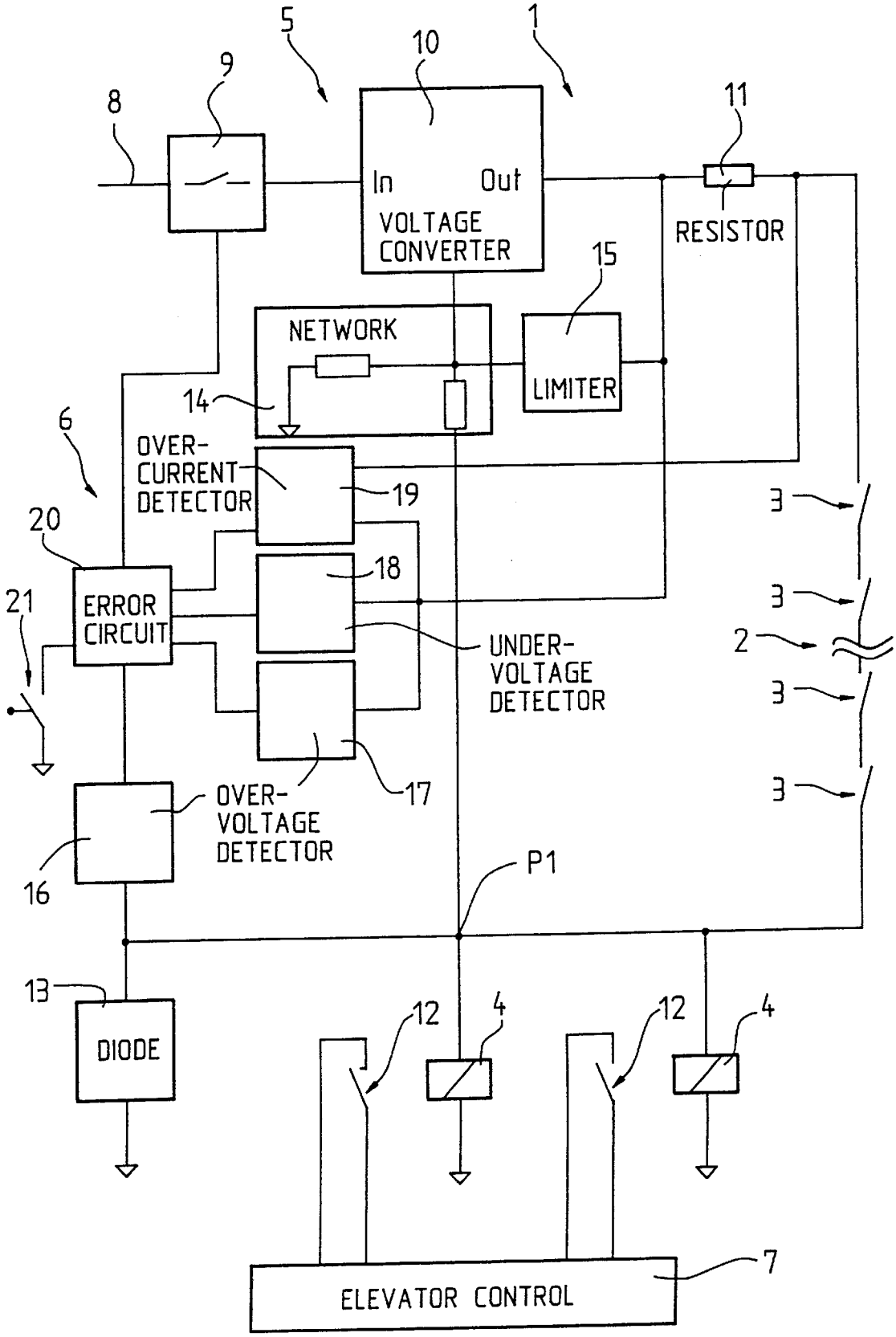
FIG. 1 is a schematic block diagram of a safety circuit with regulated voltage across a switching device in accordance with the present invention.

In FIG. 1 there is shown a safety circuit 1 that includes switches or contacts 3 connected in a series chain 2 with at least one switching device or safety relay 4 (two are shown) connected at one end of the chain. The safety circuit 1 also includes a voltage converter 10 serving as an electric power supply 5, and a monitoring device 6, with the signal from the safety relay 4 being transmitted to an elevator control 7. On an input line 8 there is, for example, a voltage of 24 V DC which is applied to an input of a protective switch 9. The protective switch 9 is connected on its output side to an input "In" of the DC-DC voltage converter 10, which increases the 24 V DC to, for example, between 25 V and 50 V DC. One end of the series chain 2 of the contacts 3 is connected via a measuring resistor 11 to an output "Out" of the voltage converter 10, while the other end of the series chain 2 is connected to a first terminal of each of the safety relays 4. A second terminal of each safety relay 4 is connected to a common line symbolized by a downward pointing arrow. The switching status of the safety relay 4 is transmitted to an associated relay contact 12 across which the elevator control 7 applies a signal voltage. To protect the safety circuit 1 against voltage spikes resulting from the switching of inductances, a protective diode 13, for example, is connected across the safety relays 4.

The voltage across the safety relay 4 which is to be regulated is tapped at a first point P1 in the circuit and transmitted to a network 14 consisting of passive elements which network is connected to the voltage converter 10. If all the contacts 3 of the series chain 2 are closed, the voltage across the safety relay 4 is held constant at, for example, 25 V DC. If the series chain 2 is open, the output voltage of the voltage converter 10 is held at, for example, 53 V DC by a limiter 15 connected to the network 14 and to the output of the voltage converter.

The monitoring device 6 consists of a first overvoltage detector 16, a second overvoltage detector 17, an undervoltage detector 18, and an overcurrent detector 19. The first overvoltage detector 16 monitors the voltage across the safety relay 4 and generates an error message if the monitored voltage exceeds, for example, 28 V DC. The second overvoltage detector 17 monitors the voltage on the output "Out" of the voltage converter 10 and generates an error message if the monitored voltage exceeds, for example, 55 V DC. The undervoltage detector 18 monitors the voltage on the output "Out" of the voltage converter 10 and generates an error message if the monitored voltage falls below, for example, 23 V DC. The overcurrent detector 19 monitors the current flowing in the series chain 2 in the form of a voltage across the measuring resistor 11 and generates an error message if the monitored current exceeds, for example, 300 mA. The error messages from the detectors 16, 17, 18, 19 are transmitted to an error circuit 20 which in the presence of at least one error message opens the protective switch 9 which switches off the voltage on the input "In" of the DC-DC voltage converter 10. The error circuit 20 stores the errors that have occurred and they can be read out by, for example, a superordinated diagnostic circuit. For the purpose of manually resetting the error circuit 20, a pushbutton switch 21 is provided.

Figure 2:
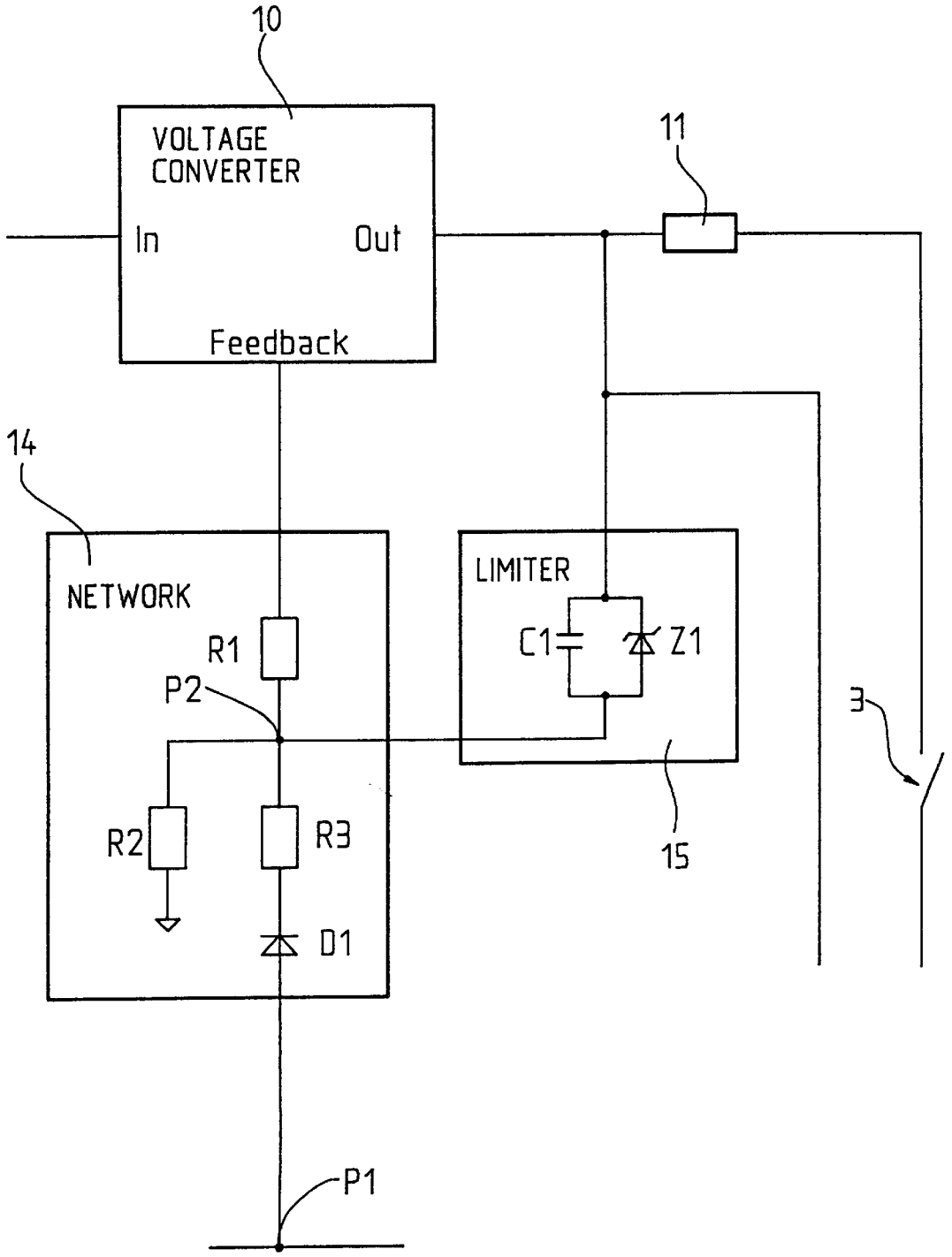
FIG. 2 is a detailed schematic diagram of one of the networks serving to regulate the voltage.

FIG. 2 shows the details of the network 14 and the limiter 15 for regulating the voltage across the safety relay 4. If the series chain 2 is open, the output voltage of the voltage converter 10 is held constant at, for example, 53 V DC by means of a zener diode Z1. A capacitor C1 connected in parallel with the zener diode reinforces the dynamic behavior of the limiter 15.

If all the contacts 3 of the series chain 2 are closed, the voltage at the point P1 across the safety relay 4 is held constant at, for example, 25 V DC. Via a diode D1 which prevents reverse current, the voltage at the point P1 is applied to a voltage divider including a resistor R3 and resistor R2 connected in series to the common line. A point of voltage division P2 between the resistors is connected to the limiter 15 and a limiting resistor R1 that is connected at its other end to a feedback input of the voltage converter 10. The voltage converter 10 uses the signal at the feedback input to regulate the voltage at the output "Out". The voltage converter 10, the series chain 2, and the network 14 form a regulating circuit that holds the voltage at the tap point P1 constant. Voltage deviations are detected by the detectors 16, 17, 18. The switching statuses of the contacts 3, the error messages from the detectors 16, 17, 18, 19, and the signals from the error circuit 20, can also be detected and analyzed by a superordinated diagnostic circuit.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A safety circuit for an elevator installation including of a chain of switch contacts connected in series to monitor equipment related to the safety of the elevator operation, an electric power supply connected to one end of the series chain, at least one switching device which generates signals for an elevator control depending on the switching status of the switches connected to another end of the series chain, the safety circuit comprising:

a regulating circuit whereby when said regulating circuit is connected to the electric power supply and the switching device, said regulating circuit holds a voltage applied by the electric power supply across the switching device constant.

2. The safety circuit according to claim 1 including a network receiving a voltage across the switching device and being connected to a feedback input of a voltage converter serving as a voltage regulator and the electrical power supply to the series chain.

3. The safety circuit according to claim 2 wherein an output of the voltage converter is connected to a limiter which is connected to said network and which limiter, when at least one of the contacts in the series chain is open, limits the voltage at the output of the voltage converter.

4. The safety circuit according to claim 2 wherein the voltage converter supplies the series chain and the switching device with a low voltage that is not dangerous to persons.

5. The safety circuit according to claim 2 including a monitoring device for monitoring voltage and current in the series chain, the switching device, and the voltage converter, and wherein said monitoring device in the event of a fault disconnects the voltage converter from an input voltage by a protective switch connected between an input line and an input of the voltage converter.

6. A safety circuit for an elevator installation comprising:

a chain of switch contacts connected in series to monitor equipment related to the safety of an elevator operation an electric power supply connected to one end of said series chain;

at least one switching device connected to another end of the series chain which switching device generates signals for an elevator control depending on the switching status of the switch contacts; and a regulating circuit connected to said electric power supply and to said switching device, said regulating circuit holding a voltage applied by said electric power supply across said switching device constant.

7. The safety circuit according to claim 6 wherein said electric power supply includes a voltage converter serving as a voltage regulator and including a network receiving a voltage across said switching device being connected to a feedback input of said voltage converter.

8. The safety circuit according to claim 7 wherein said network includes a pair of resistors connected in series between said switching device and said feedback input and another resistor connected between a common line and a point of voltage division between said pair of resistors.

9. The safety circuit according to claim 7 wherein an output of said voltage converter is connected to a limiter which is connected to said network and which limiter, when at least one of said contacts in said series chain is open, limits the voltage at said output of said voltage converter.

10. The safety circuit according to claim 7 wherein said limiter includes a zener diode and a capacitor connected in parallel between said network and said voltage converter output.

11. The safety circuit according to claim 7 wherein said voltage converter supplies said series chain and said switching device with a low voltage that is not dangerous to persons.

12. The safety circuit according to claim 11 wherein said low voltage is approximately 25 V DC if all of said contacts are closed and is approximately 55 V DC if at least one of said contacts is open.

13. The safety circuit according to claim 7 including a monitoring device connected for monitoring voltage and current in said series chain, said switching device, and said voltage converter, and wherein said monitoring device in the event of a fault disconnects said voltage converter from an input voltage by a protective switch connected between an input line and an input of said voltage converter.

* * * * *